US009987720B2

(12) United States Patent
Suen et al.

(10) Patent No.: US 9,987,720 B2
(45) Date of Patent: Jun. 5, 2018

(54) METHOD FOR OPERATING A POLISHING HEAD AND METHOD FOR POLISHING A SUBSTRATE

(71) Applicant: TAIWAN SEMICONDUCTOR MANUFACTURING COMPANY, LTD., Hsinchu (TW)

(72) Inventors: Shich-Chang Suen, Hsinchu (TW); Chin-Hsiang Chan, New Taipei (TW); Liang-Guang Chen, Hsinchu (TW); Yung-Cheng Lu, Hsinchu (TW)

(73) Assignee: TAIWAN SEMICONDUCTOR MANUFACTURING CO., LTD., Hsinchu (TW)

( * ) Notice: Subject to any disclaimer, the term of this patent is extended or adjusted under 35 U.S.C. 154(b) by 184 days.

(21) Appl. No.: 15/008,707

(22) Filed: Jan. 28, 2016

(65) Prior Publication Data

US 2016/0136777 A1 May 19, 2016

Related U.S. Application Data

(62) Division of application No. 14/058,054, filed on Oct. 18, 2013, now Pat. No. 9,272,386.

(51) Int. Cl.

| | |
|---|---|
| ***B24B 37/20*** | (2012.01) |
| ***B24D 9/08*** | (2006.01) |
| ***B24B 37/005*** | (2012.01) |
| ***B24B 49/10*** | (2006.01) |
| ***B24B 37/30*** | (2012.01) |
| *B24B 37/04* | (2012.01) |
| *B24B 41/06* | (2012.01) |

(52) U.S. Cl.

CPC ..... *B24B 37/20* (2013.01); *B24B 37/005* (2013.01); *B24B 37/30* (2013.01); *B24B 49/10* (2013.01); *B24D 9/08* (2013.01); *B24B 37/04* (2013.01); *B24B 41/06* (2013.01)

(58) Field of Classification Search

CPC ..... B24B 37/005; B24B 37/04; B24B 37/042; B24B 37/046; B24B 37/10; B24B 37/107; B24B 37/30; B24B 41/06; B24B 49/10; B24B 51/00

See application file for complete search history.

(56) References Cited

U.S. PATENT DOCUMENTS 5,916,016 A * 6/1999 Bothra ..... B24B 37/107 451/289
6,059,638 A 5/2000 Crevasse et al.
6,436,828 B1 8/2002 Chen et al.

(Continued)

OTHER PUBLICATIONS

Non-Final Office Action U.S. Appl. No. 14/058,054 dated Jul. 7, 2015.

(Continued)

*Primary Examiner* — Timothy V Eley
(74) *Attorney, Agent, or Firm* — McDermott Will & Emery LLP

(57) ABSTRACT

A method for operating a polishing head is provided. The method includes keeping a stator of at least one electromagnetism actuated pressure sector stationary with respect to a carrier head, and electromagnetically and linearly moving an active cell of the electromagnetism actuated pressure sector with the stator to linearly move the active cell with respect to the carrier head.

20 Claims, 7 Drawing Sheets

(56) References Cited

U.S. PATENT DOCUMENTS

| | | | | |
|---|---|---|---|---|
| 7,004,817 | B2 | 2/2006 | Chandrasekaran | |
| 7,033,251 | B2 | 4/2006 | Elledge | |
| 7,066,785 | B2 | 6/2006 | Park et al. | |
| 7,147,543 | B2 | 12/2006 | Chandrasekaran | |
| 7,255,630 | B2 | 8/2007 | Elledge | |
| 7,488,235 | B2 | 2/2009 | Park et al. | |
| 7,947,190 | B2 | 5/2011 | Brown | |
| 2014/0273766 | A1* | 9/2014 | Chang | B24B 37/042 451/59 |

OTHER PUBLICATIONS

Notice of Allowance U.S. Appl. No. 14/058,054 dated Oct. 22, 2015.

* cited by examiner

METHOD FOR OPERATING A POLISHING HEAD AND METHOD FOR POLISHING A SUBSTRATE

RELATED APPLICATIONS

This application is a divisional application of a non-provisional application Ser. No. 14/058,054, filed Oct. 18, 2013, which is herein incorporated by reference.

BACKGROUND

In general, the current design of a polishing head of a chemical-mechanical polishing system allows a control on its polish profile. However, this control only allows for the zones along the radial directions. Thus, there is a problem when there is an asymmetric topography of the polish profile.

On the other hand, the current method of profile control utilizes the deformation of the membrane by pneumatic mechanism However, the application of pneumatic pressure is sometimes technically out of control, affecting the polish profile of the polishing head.

Therefore, there is a need to solve the above deficiencies/problems.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Figure 1:
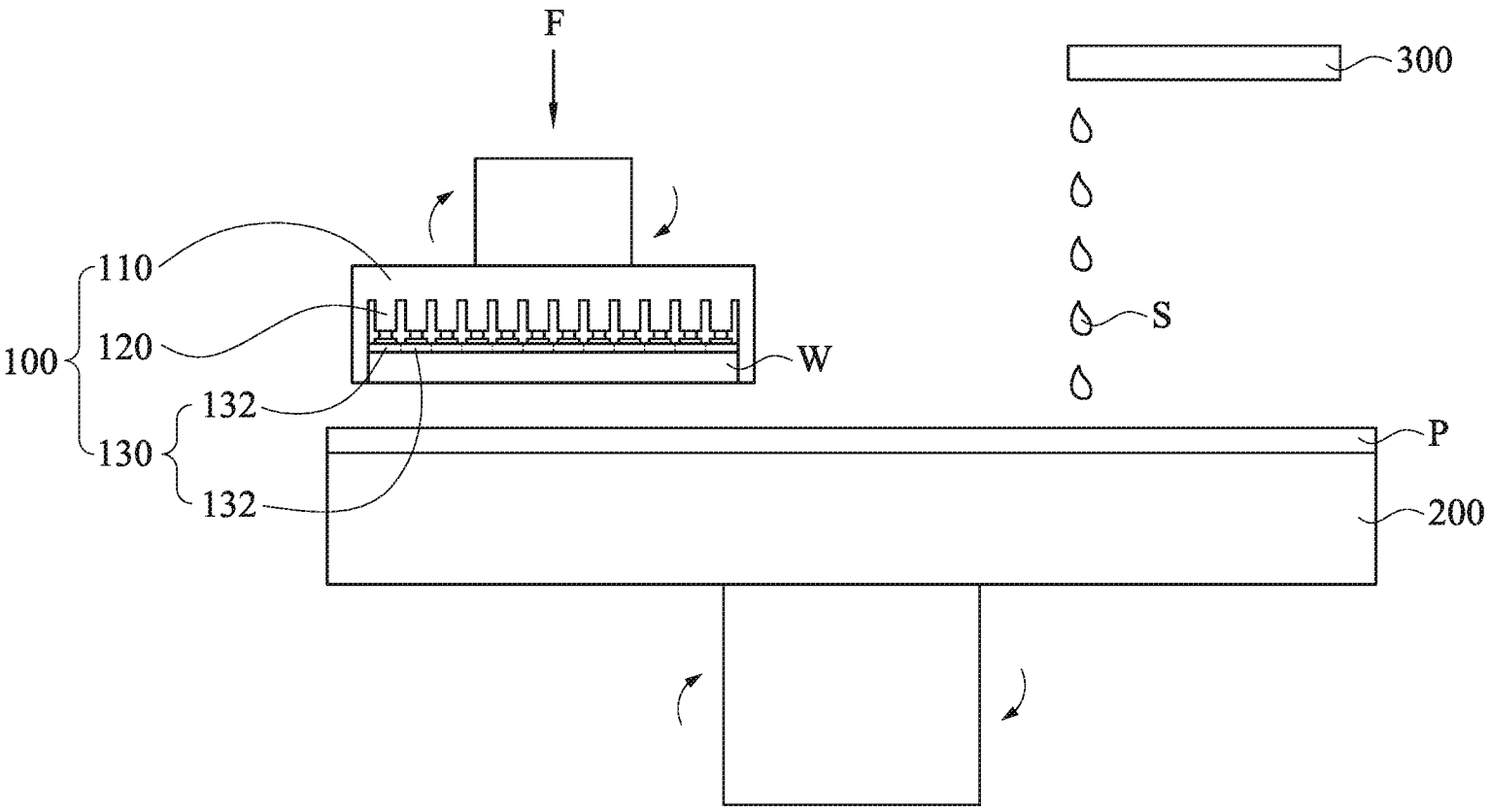
FIG. 1 shows schematically a general arrangement of the polishing head in a chemical-mechanical polishing system according to some embodiments in the present disclosure.

Chemical-mechanical polishing is a process in which an abrasive slurry and a polishing pad work simultaneously together in both the chemical and mechanical approaches to flaten a substrate, or more specific a wafer. FIG. 1 is a schematic view of a chemical-mechanical polishing system according to some embodiments of the present disclosure. As shown in FIG. 1, the chemical-mechanical polishing system includes a polishing head 100, a platen 200, and a slurry introduction mechanism 300. The polishing head 100 includes a carrier head 110, at least one electromagnetism actuated pressure sector 120, and a membrane 130. The electromagnetism actuated pressure sector 120 is disposed on the carrier head 110. As shown in FIG. 1, a plurality of the electromagnetism actuated pressure sectors 120 are arranged on the carrier head 110. The membrane 130 covers the electromagnetism actuated pressure sectors 120. Meanwhile, the platen 200 is disposed below the polishing head 100, and the slurry introduction mechanism 300 is disposed above the platen 200.

When the chemical-mechanical polishing system is in use, a polishing pad P is disposed on the platen 200. The polishing head 100 holds a substrate W against the polishing pad P. Both the polishing head 100 and the platen 200 are rotated, and thus both the substrate W and the polishing pad P are rotated as well. The slurry introduction mechanism 300 supplies and deposits slurry S onto the polishing pad P. The cooperation between the slurry S and the polishing pad P removes material on the substrate W and tends to even out any irregular topography, making the substrate W flat or planar.

When the chemical-mechanical polishing system is in use, a downward pressure/down force F is applied to the polishing head 100, pushing the substrate W against the polishing pad P. Furthermore, localized pressures may be applied to the substrate W in order to control the polish profile of the substrate W. This can be achieved by the electromagnetism actuated pressure sectors 120. The electromagnetism actuated pressure sectors 120 are sectors that can be individually and electromagnetically actuated to push the substrate W against the polishing pad P.

Figure 2:
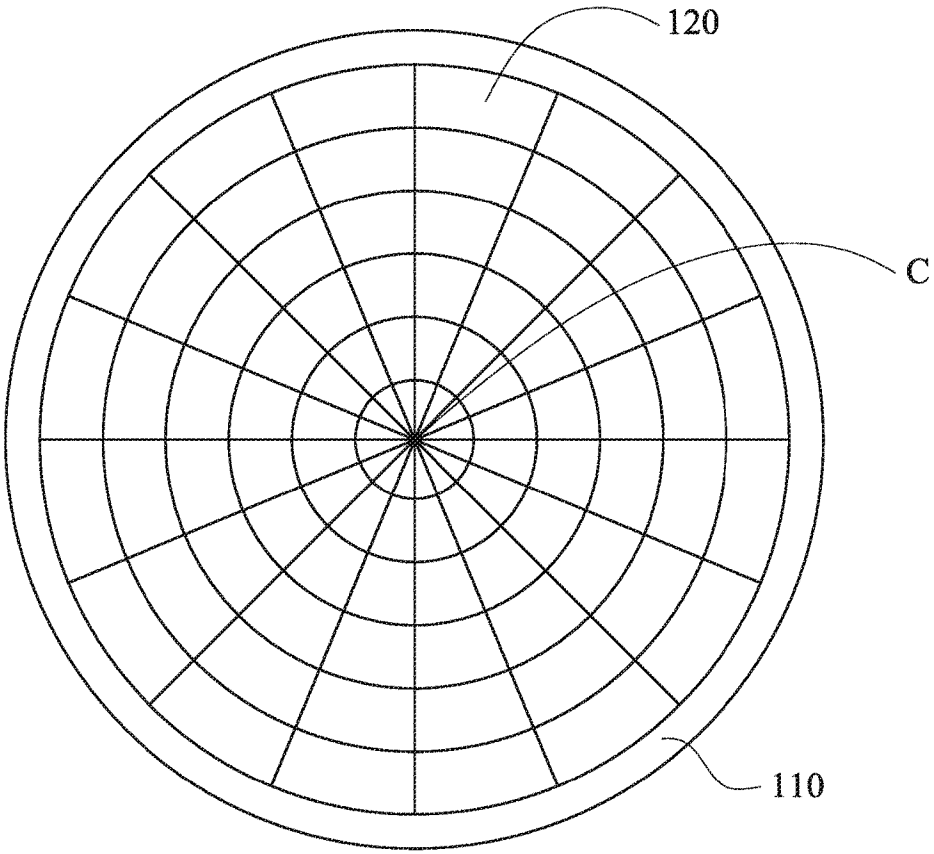
FIG. 2 shows schematically a bottom view of the electromagnetism actuated pressure sectors of FIG. 1.

FIG. 2 is a bottom view of the electromagnetism actuated pressure sectors 120 of FIG. 1. As shown in FIG. 2, the electromagnetism actuated pressure sectors 120 are at least partially arranged along at least one circumferential line relative to a center axis C of the carrier head 110. That is, at least two of the electromagnetism actuated pressure sectors 120 are located on the same circumferential line relative to the center axis C of the carrier head 110. In this way, the profile control of the substrate W can be carried out along at least one circumferential line relative to the center axis of the substrate W. In FIG. 2, the electromagnetism actuated pressure sectors 120 are arranged in substantially circumferential and radial lines relative to the center axis C of the carrier head 110.

As shown in FIG. 1, the membrane 130 abuts against the electromagnetism actuated pressure sectors 120. More specifically, the membrane 130 is divided into a plurality of zones 132. The zones 132 of the membrane 130 respectively abut against the electromagnetism actuated pressure sectors 120. The displacements of the zones 132 of the membrane 130 are controlled by the respective electromagnetism actuated pressure sectors 120.

In the operational point of view, the profile control of the substrate W can be carried out by individually and electromagnetically actuating at least two of the electromagnetism actuated pressure sectors 120 on the same circumferential line relative to the center axis of the substrate W. That is, with a plurality of the electromagnetism actuated pressure sectors 120 being individually and electromagnetically actuated, the electromagnetism actuated pressure sectors 120 on the same circumferential line relative to the center axis of the substrate W can apply different forces to the substrate W, thereby applying the localized pressures to the substrate W. Since the localized pressures can be applied to the substrate W, the asymmetry topography on the substrate W can be handled.

A quantity of the electromagnetism actuated pressure sectors 120 arranged on the carrier head 110 can range from about 5 to about 400. Technically speaking, the area of at least one of the zones 132 can be as small as about 1×1 $cm^2$. This can facilitate a more precise profile control of the substrate W to be polished, and the profile discontinuity of the removal rate is reduced as well.

Figure 3:
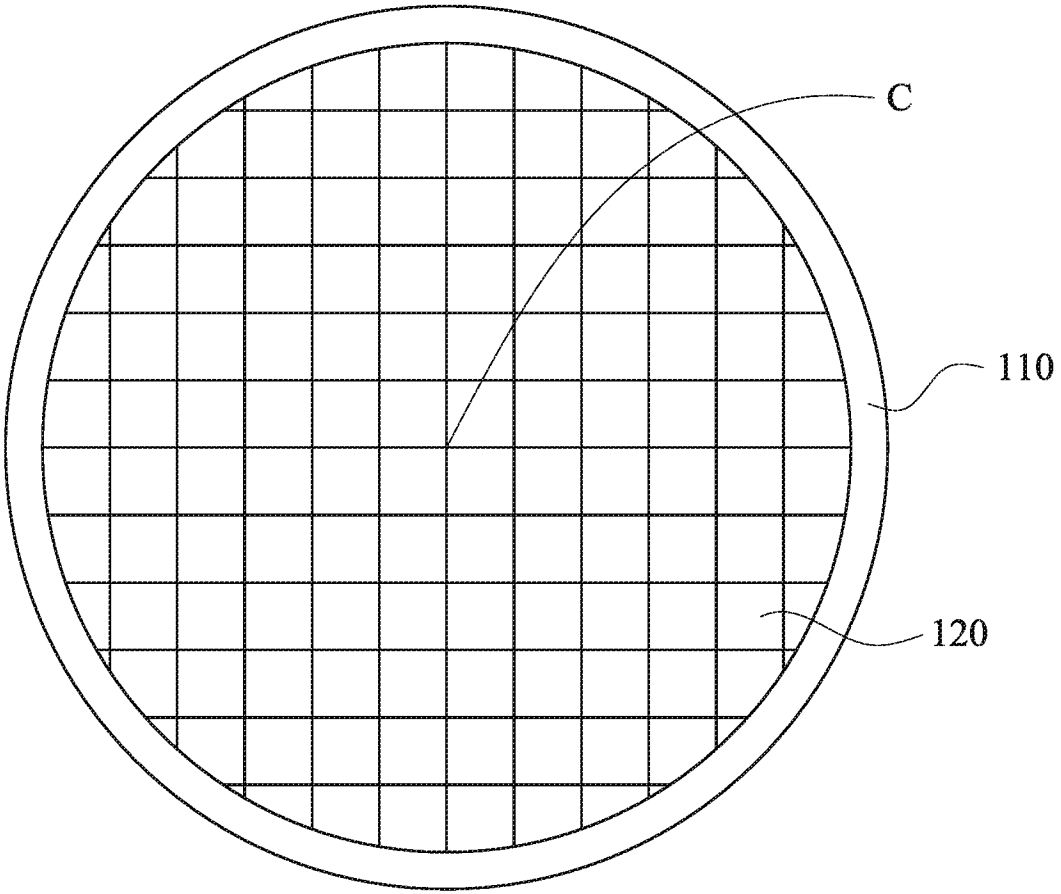
FIG. 3 shows schematically a bottom view of the electromagnetism actuated pressure sectors according to some embodiments of the present disclosure.

FIG. 3 is a bottom view of the electromagnetism actuated pressure sectors 120 according to some embodiments of the present disclosure. In practice, the pattern arrangement of the electromagnetism actuated pressure sectors 120 on the carrier head 110 has a high flexibility, with the area of at least one of the zones 132 can be technically as small as about 1×1 $cm^2$, as mentioned above. As shown in FIG. 3, the electromagnetism actuated pressure sectors 120 are at least partially arranged in at least one row and at least one column.

Figure 4:
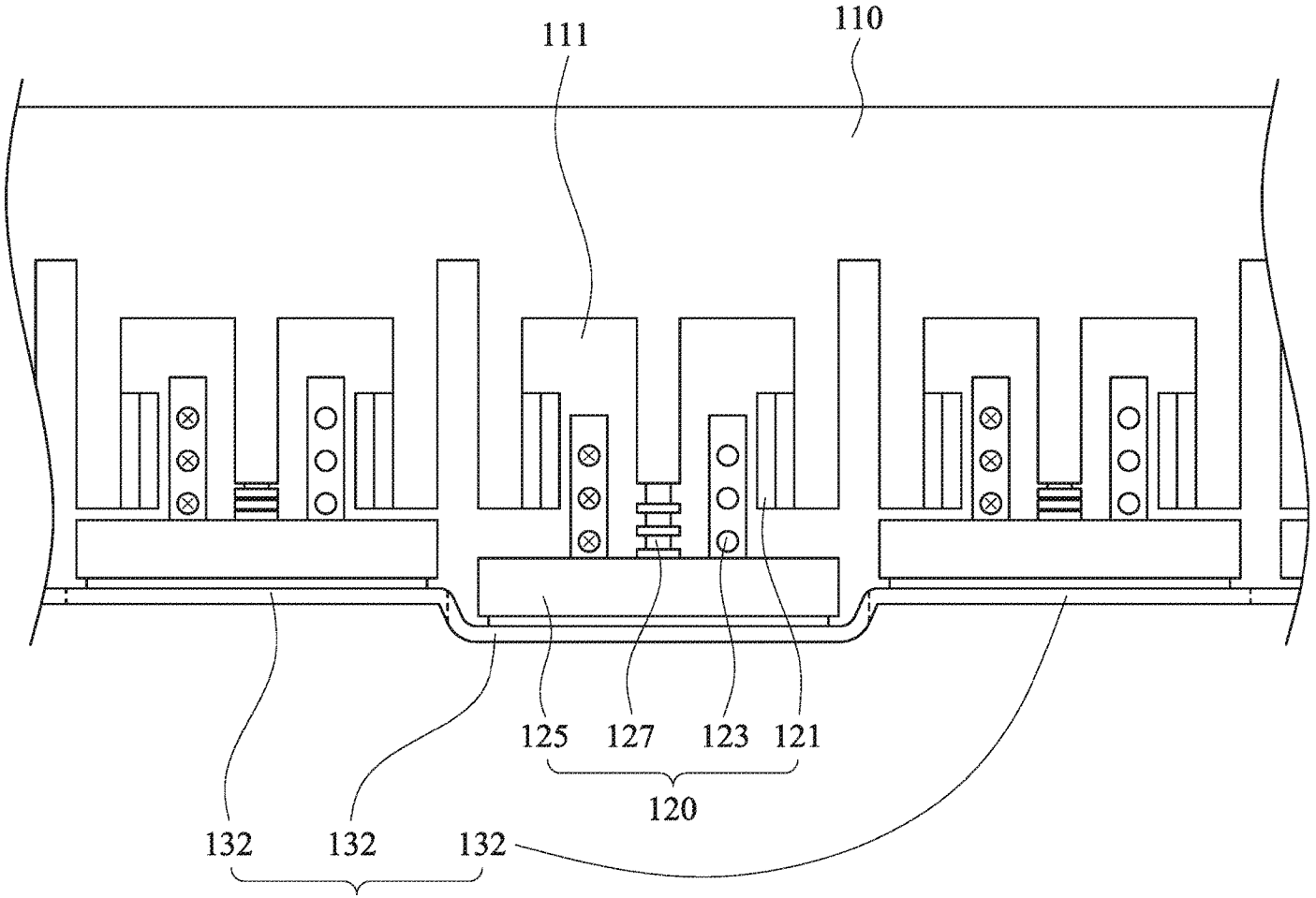
FIG. 4 shows schematically a sectional view of the electromagnetism actuated pressure sectors in FIG. 1.

FIG. 4 is a schematic sectional view of the electromagnetism actuated pressure sectors 120 of FIG. 1. The carrier head 110 has at least one opening 111 therein. At least one of the electromagnetism actuated pressure sectors 120 includes a permanent magnet 121, a coil assembly 123, and a sector plate 125. The permanent magnet 121 is located in the opening 111. The coil assembly 123 is telescopically received in the opening 111 and in cooperation with the permanent magnet 121. The sector plate 125 is connected to the coil assembly 123.

The profile control of the substrate W to be polished is achieved by the individual motions of the electromagnetism actuated pressure sectors 120, or more specific the movements of the sector plates 125 of the electromagnetism actuated pressure sectors 120 relative to the carrier head 110. The working principle of the movements of the sector plates 125 of the electromagnetism actuated pressure sectors 120 relative to the carrier head 110 is as follows. The permanent magnet 121 in the opening 111 generates a magnetic field. Within this magnetic field, when an electric current flows through the coil assembly 123, according to the Fleming's left-hand rule, the coil assembly 123 experiences an electromagnetic force. This electromagnetic force is perpendicular to both this magnetic field generated and to the flow direction of the electric current, causing the movement of the coil assembly 123.

The flow direction of the electric current controls the direction of the movement of the coil assembly 123. Without loss of generality, in some embodiments of the present disclosure, when the electric current flows in one direction, for example, a clockwise direction, through the coil assembly 123, the electromagnetic force generated will move the coil assembly 123 and the sector plate 125 away from the carrier head 110. In contrast, when the electric current flows in another direction, for example, an anti-clockwise direction, through the coil assembly 123, the electromagnetic force generated will move the coil assembly 123 and the sector plate 125 close to the carrier head 110. The individual movements of the sector plates 125 will consequently move the respective zones 132 of the membrane 130 since the membrane 130 abuts against the sector plates 125 of the electromagnetism actuated pressure sectors 120.

The magnitude of the electromagnetic force generated is proportional to the amount of the electric current flowing through the coil assembly 123. Therefore, the displacement of the sector plate 125 and thus the displacement of the respective zone 132 of the membrane 130 are proportional to the amount of the electric current flowing through the coil assembly 123.

Moreover, in some embodiments of the present disclosure, the flow direction and the amount of the electric current flowing through each coil assembly 123 can be controlled by an integrated circuit. Therefore, the direction and the magnitude of the corresponding electromagnetic force which the coil assembly 123 experiences can be digitally, individually and precisely controlled. Consequently, the directions and the magnitudes of the movements of the sector plates 125 and thus the respective zones 132 of the membrane 130 can be digitally, individually and precisely controlled by the integrated circuit. In this way, a gradient control of the movements of the zones 132 of the membrane 130 can be achieved.

As shown in FIG. 4, at least one of the electromagnetism actuated pressure sectors 120 further includes an elastic element 127 connecting the sector plate 125 to the carrier head 110. In some embodiments of the present disclosure, the elastic element 127 elongates when the sector plate 125 is moved away from the carrier head 110 by the electromagnetic force generated by the electric current flowing through the coil assembly 123. When the flow of the electric current is stopped, the elastic element 127 will release the potential energy stored during its elongation, and the elastic element 127 will go back to its natural length. In contrast, the elastic element 127 shortens when the sector plate 125 is moved close to the carrier head 110 by the electromagnetic force generated by the electric current flowing through the coil assembly 123. Similarly, when the flow of the electric current is stopped, the elastic element 127 will release the potential energy stored during its shrinkage, and the elastic element 127 will go back to its natural length.

Figure 5:
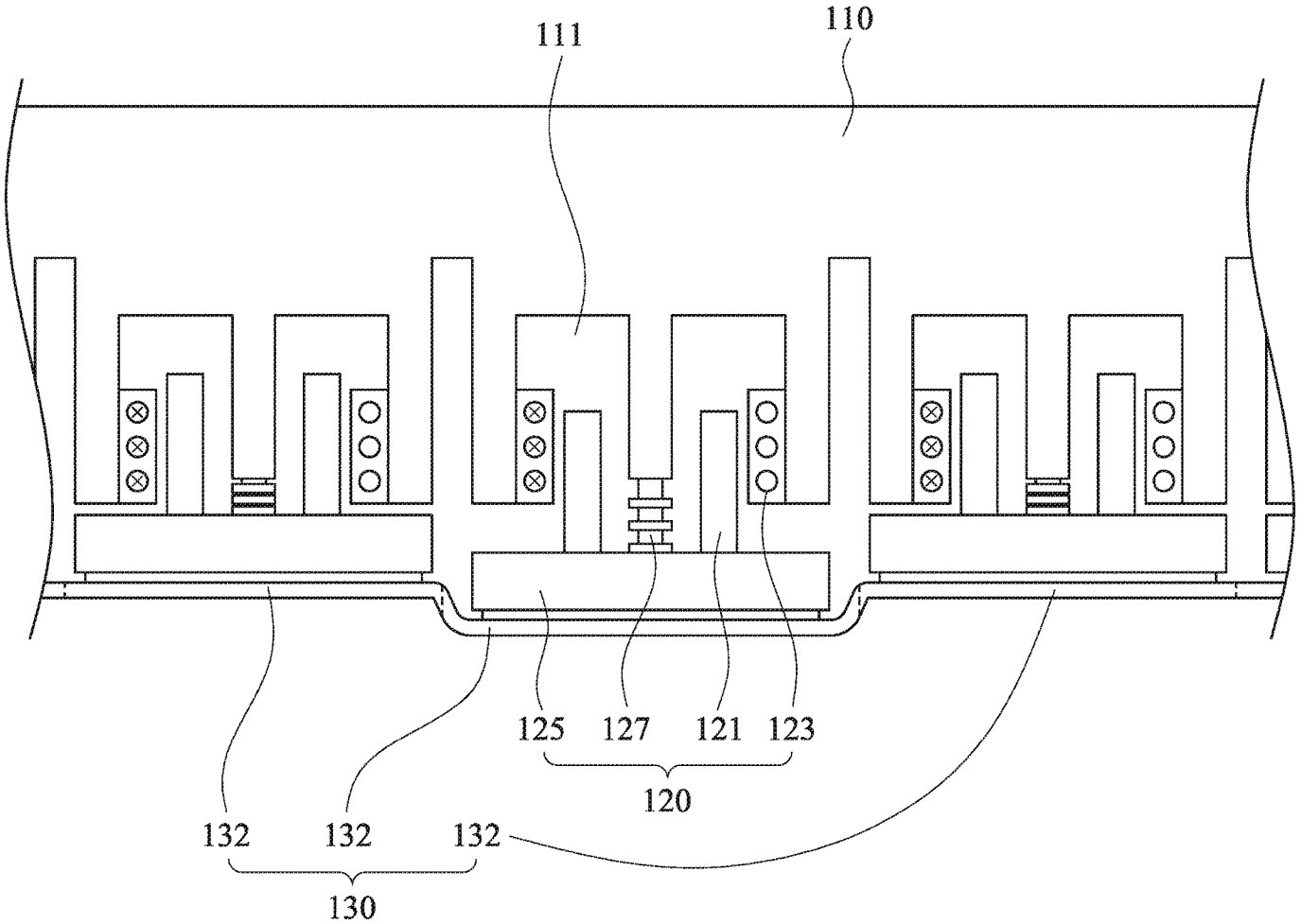
FIG. 5 shows schematically a sectional view of the electromagnetism actuated pressure sectors according to some embodiments of the present disclosure.

In some embodiments of the present disclosure, the positions of the permanent magnet 121 and the coil assembly 123 can be exchanged. FIG. 5 is a schematic sectional view of the electromagnetism actuated pressure sectors 120 according to some embodiments of the present disclosure. The coil assembly 123 is located in the opening 111. The permanent magnet 121 is telescopically received in the opening 111 and in cooperation with the coil assembly 123. The sector plate 125 is connected to the permanent magnet 121. In this arrangement, as shown in FIG. 5, at least one of the electromagnetism actuated pressure sectors 120 also includes the elastic element 127 connecting the sector plate 125 to the carrier head 110.

With a similar working principle, when an electric current flows through the coil assembly 123, according to the right-hand grip rule, a magnetic field will be generated around the coil assembly 123. The magnetic field generated around the coil assembly 123 will interact with the magnetic field generated by the permanent magnet 121. Thus, an electromagnetic force is generated, causing the movement of the permanent magnet 121.

Again, similarly, the flow direction of the electric current controls the direction of the movement of the permanent magnet 121, and thus the movement of the sector plate 125 of the electromagnetism actuated pressure sectors 120. Moreover, the magnitude of the electromagnetic force generated is proportional to the amount of the electric current flowing through the coil assembly 123.

As shown in FIGS. 4-5, the membrane 130 abuts against the sector plates 125 of the electromagnetism actuated pressure sectors 120. In this way, the zones 132 of the membrane 130 can respond instantly to the movements of the respective sector plates 125 of the electromagnetism actuated pressure sectors 120. Moreover, the membrane 130 acts as a chemical-proof layer to prevent chemicals or the slurry from getting contact with the electromagnetism actuated pressure sectors 120. In some embodiments of the present disclosure, the material of the membrane 130 is plastic.

Figure 6:
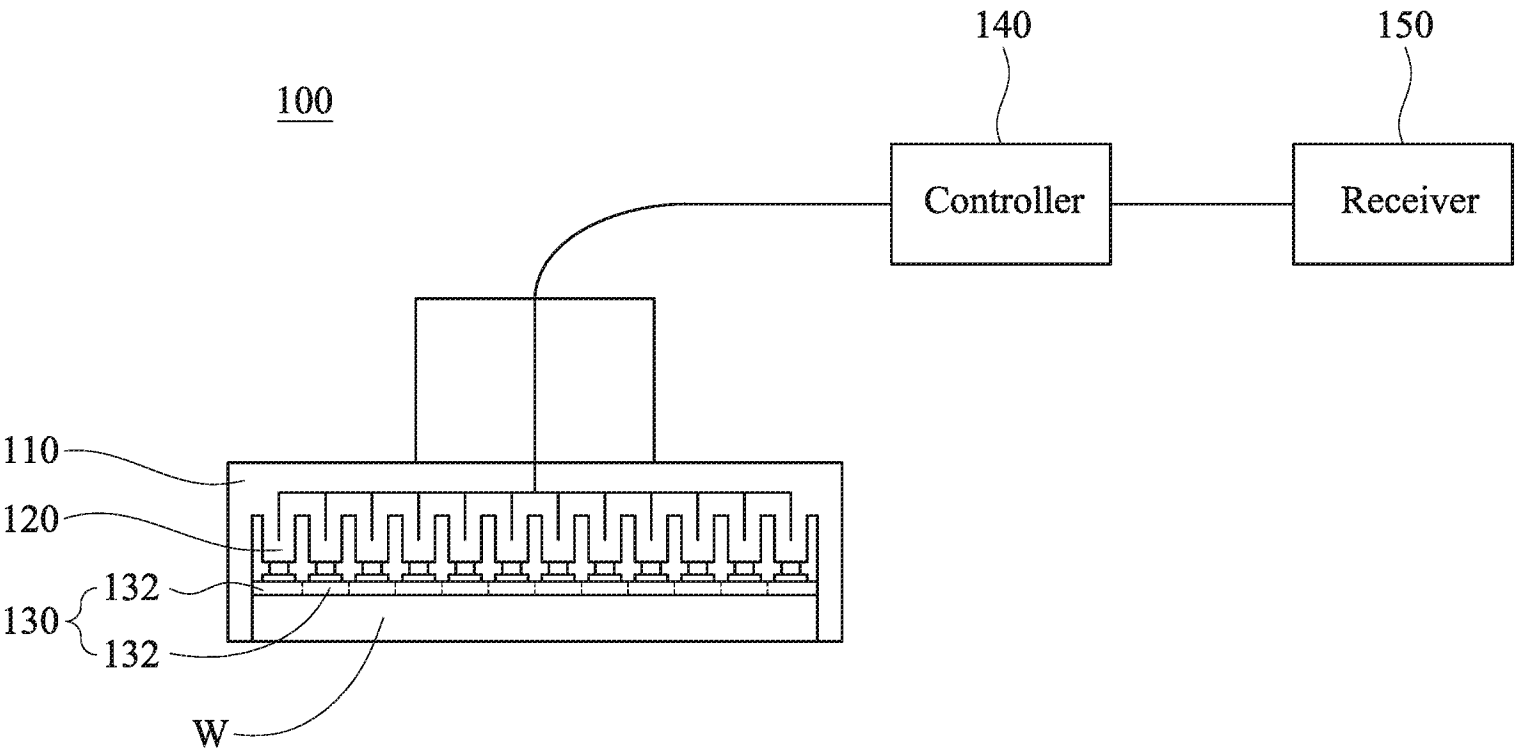
FIG. 6 shows schematically a drawing of the polishing head according to some embodiments of the present disclosure.

FIG. 6 is a schematic drawing of the polishing head 100 according to some embodiments of the present disclosure. As shown in FIG. 6, the polishing head 100 further includes a receiver 150 and a controller 140. The receiver 150 is connected to the controller 140, and the controller 140 is connected to the electromagnetism actuated pressure sectors 120. The receiver 150 is used for obtaining a pre-polished process data. On the other hand, the controller 140 is used for controlling the motions of the electromagnetism actuated pressure sectors 120, or more specific the movements of the sector plate 125 of the electromagnetism actuated pressure sectors 120, according to the pre-polished process data.

When the chemical-mechanical polishing system is in use, the receiver 150 obtains a pre-polished process data. The pre-polished process data may represent a pre-polished profile of the substrate W, a surface temperature of the substrate W, an electric resistance of the substrate W, etc., or any combinations thereof. Then, the controller 140 can control the motions of the electromagnetism actuated pressure sectors 120, or more specific the movements of the sector plates 125 of the electromagnetism actuated pressure sectors 120, according to the pre-polished process data.

In the operational point of view, the sector plates 125 are electromagnetically actuated according to the pre-polished process data. For example, when the received pre-polished process data represents that the substrate W is thicker at the center of the substrate W, the controller 140 will control the electromagnetism actuated pressure sectors 120 to provide more pressure to the center of the substrate W when both the polishing head 100 and the platen 200 are rotated.

Furthermore, the polishing head 100 includes the controller 140 for in-situ controlling the motion of the electromagnetism actuated pressure sectors 120. When the chemical-mechanical polishing system is in use, the controller 140 can in-situ control the motion of the electromagnetism actuated pressure sectors 120, or more specific the movements of the sector plates 125 of the electromagnetism actuated pressure sectors 120, as well. That is, the controller 140 can control the motions of the electromagnetism actuated pressure sectors 120, or more specific the movements of the sector plates 125 of the electromagnetism actuated pressure sectors 120, when both the polishing head 100 and the platen 200 are rotated.

More specifically, when the chemical-mechanical polishing system is in use, the receiver 150 can obtain an in-situ process data. The in-situ process data may represent an in-situ profile of the substrate W, a surface temperature of the substrate W, an electric resistance of the substrate W, etc., or any combinations thereof. Then, the controller 140 can in-situ control the motion of the electromagnetism actuated pressure sectors 120, or more specific the movements of the sector plates 125 of the electromagnetism actuated pressure sectors 120, according to the in-situ process data.

In the operational point of view, the sector plates 125 are electromagnetically actuated when both the substrate W and the polishing pad P are rotated. For example, when the received in-situ process data represents that the substrate W is thicker at the center of the substrate W, the controller 140 will control the electromagnetism actuated pressure sectors 120 to provide more pressure to the center of the substrate W when both the polishing head 100 and the platen 200 are rotated.

In practice, as aforementioned, the controller 140 controls the motions of the electromagnetism actuated pressure sectors 120 by the electric current. Or more specifically, the controller 140 controls both the direction and the magnitude of the movements of the sector plates 125 of the electromagnetism actuated pressure sectors 120, and this is achieved by the adjustment of the flow direction and the magnitude of the electric current. Thus, the control of the polish profile can be precisely digitalized.

Figure 7:
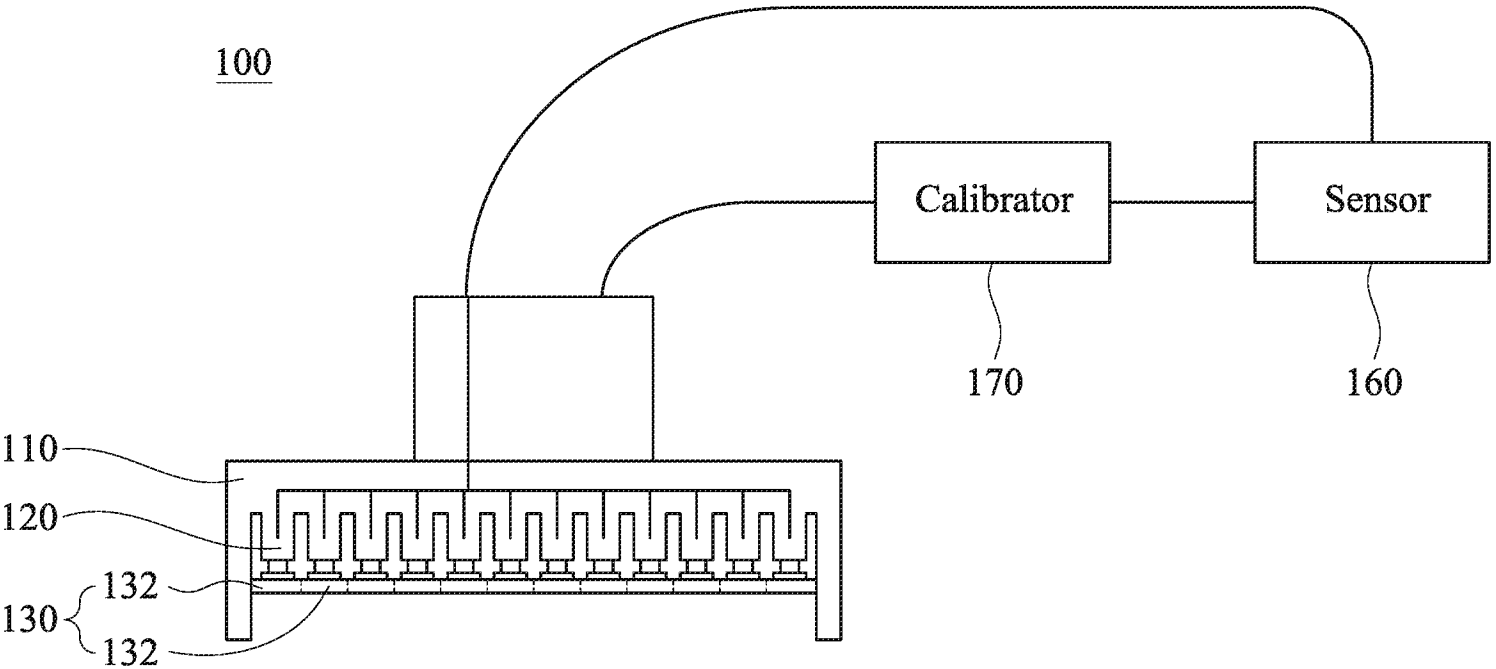
FIG. 7 shows schematically a drawing of the polishing head according to some embodiments of the present disclosure.

FIG. 7 is a schematic drawing of the polishing head 100 according to some embodiments of the present disclosure. As shown in FIG. 7, the polishing head 100 further includes a sensor 160 and a calibrator 170. The carrier head 110, the electromagnetism actuated pressure sectors 120, the sensor 160, and the calibrator 170 are connected to one another. The sensor 160 is used for sensing the displacements of the electromagnetism actuated pressure sectors 120, or more specific the displacements of the sector plates 125 of the electromagnetism actuated pressure sectors 120. The calibrator 170 is used for calibrating the carrier head 110 according to the sensed displacements of the electromagnetism actuated pressure sectors 120, or more specific the displacements of the sector plates 125 of the electromagnetism actuated pressure sectors 120.

After the prevention maintenance of the chemical-mechanical polishing system, the sensor 160 can be used to sense the displacement of the sector plate 125 of at least one of the electromagnetism actuated pressure sectors 120. In other words, this is to check for a residual displacement remained after the movements of the sector plate 125 of the electromagnetism actuated pressure sector 120. A reason for a residual displacement of the sector plate 125 is that the potential energy stored in the elastic element 127 is not substantially released after the displacement of the sector plate 125. Thus, the elastic element 127 has not gone back to its natural length, and the residual displacement is formed. Another reason is that the natural length of the elastic element 127 has changed. Thus, the elastic element 127 does not go back to the original natural length, even though the potential energy stored during the displacement of the sector plate 125 is substantially released. Whatever the reason, the calibrator 170 can then calibrate the carrier head 110 according to the sensed displacement of the sector plate 125 of at least one of the electromagnetism actuated pressure sectors 120. In this way, the performance of the polishing head 100 is maintained.

In some embodiments of the present disclosure, the polishing head 100 for the chemical-mechanical polishing system includes the carrier head 110, at least one electromagnetism actuated pressure sector 120 and the membrane 130. The electromagnetism actuated pressure sectors 120 are arranged on the carrier head 110. The membrane 130 covers the electromagnetism actuated pressure sectors 120.

In some embodiments of the present disclosure, the chemical-mechanical polishing system includes the polishing head 100, the platen 200 and the slurry introduction mechanism 300. The polishing head 100 includes the carrier head 110, a plurality of the electromagnetism actuated pressure sectors 120 and the membrane 130. The electromagnetism actuated pressure sectors 120 are arranged on the carrier head 110. The membrane 130 covers the electromagnetism actuated pressure sectors 120. Meanwhile, the platen 200 is disposed below the polishing head 100, and the slurry introduction mechanism 300 is disposed above the platen 200.

In some embodiments of the present disclosure, the method of polishing a substrate W includes supplying the slurry S onto the polishing pad P, holding the substrate W against the polishing pad P, electromagnetically actuating a plurality of electromagnetism actuated pressure sectors 120 to push the substrate W against the polishing pad P, and relatively rotating the polishing pad P and the substrate W.

Although the present disclosure has been described in considerable detail with reference to certain embodiments thereof, other embodiments are possible. Therefore, their spirit and scope of the appended claims should not be limited to the description of the embodiments contained herein.

It will be apparent to those skilled in the art that various modifications and variations can be made to the structure of the present disclosure without departing from the scope or spirit of the present disclosure. In view of the foregoing, it is intended that the present disclosure covers the modifications and variations of the present disclosure provided they fall within the scope of the following claims.

What is claimed is:

1. A method for operating a polishing head, the method comprising:

keeping a first portion of at least one electromagnetism actuated pressure sector stationary with respect to a carrier head, wherein the polishing head comprises the carrier head, and the first portion is in the carrier head; and electromagnetically cooperating second portion of the at least one electromagnetism actuated pressure sector with the first portion to linearly move the second portion with respect to the carrier head, wherein at least one sector plate is connected to the second portion, and electromagnetically cooperating the second portion with the first portion is performed such that an elastic element connecting the at least one sector plate and the carrier head is elongated when the second portion moves away from the carrier head.

2. The method of claim 1, wherein a number of the at least one electromagnetism actuated pressure sector is plural, each having the second portion, a number of the at least one sector plate is plural, the sector plates are respectively connected to the second portions of the electromagnetism actuated pressure sectors, and the electromagnetically cooperating comprises:

respectively moving at least two of the sector plates located on the same circumferential line relative to a center axis of the carrier head with respect to the carrier head.

3. The method of claim 1, wherein a number of the at least one electromagnetism actuated pressure sector is plural, each having the second portion, a number of the at least one sector plate is plural, the sector plates are respectively connected to the second portions of the electromagnetism actuated pressure sectors, and the electromagnetically cooperating comprises:

respectively moving at least two of the sector plates located on the same radial line relative to a center axis of the carrier head with respect to the carrier head.

4. The method of claim 1, wherein a number of the at least one electromagnetism actuated pressure sector is plural, each having the second portion, a number of the at least one sector plate is plural, the sector plates are respectively connected to the second portions of the electromagnetism actuated pressure sectors, and the electromagnetically cooperating comprises:

respectively moving at least two of the sector plates located on the same row of the carrier head with respect to the carrier head.

5. The method of claim 4, wherein a number of the at least one electromagnetism actuated pressure sector is plural, each having the second portion, a number of the at least one sector plate is plural, the sector plates are respectively connected to the second portions of the electromagnetism actuated pressure sectors, and the electromagnetically cooperating comprises:

respectively moving at least two of the sector plates located on the same column substantially perpendicular to the row of the carrier head with respect to the carrier head.

6. The method of claim 1, further comprising:

shortening the elastic element when the second portion moves close to the carrier head.

7. The method of claim 1, further comprising:

controlling a movement of the at least one sector plate with respect to the carrier head by an electric current.

8. The method of claim 1, further comprising:

obtaining a pre-polished process data; and controlling a movement of the at least one sector plate with respect to the carrier head according to the pre-polished process data.

9. The method of claim 1, further comprising:

in-situ controlling a movement of the at least one sector plate with respect to the carrier head.

10. The method of claim 1, further comprising:

sensing a displacement of the at least one sector plate; and calibrating the carrier head according to the sensed displacement of the at least one sector plate.

11. The method of claim 1, wherein the electromagnetically cooperating comprises:

cooperating an electromagnetism provided by the second portion and a permanent magnetism provided by the first portion to linearly move the second portion with respect to the first portion.

12. A method for polishing a substrate, the method comprising:

sensing a displacement of at least one sector, wherein the at least one sector is disposed in a carrier head;

calibrating the carrier head according to the sensed displacement of the at least one sector;

supplying slurry onto a polishing pad;

holding the substrate against the polishing pad;

electromagnetically actuating the at least one sector to telescopically move to push the substrate against the polishing pad; and rotating at least one of the polishing pad and the substrate.

13. The method of claim 12, wherein a number of the at least one sector is plural, and the electromagnetically actuating the sectors comprises:

individually and electromagnetically actuating at least two of the sectors located on the same circumferential line relative to a center axis of the substrate.

14. The method of claim 12, wherein a number of the at least one sector is plural, and the electromagnetically actuating the sectors comprises:

individually and electromagnetically actuating a plurality of the sectors.

15. The method of claim 12, further comprising:

obtaining a pre-polished process data;

wherein the electromagnetically actuating the at least one sector comprises:

electromagnetically actuating the at least one sector according to the pre-polished process data.

16. The method of claim 12, wherein the electromagnetically actuating the at least one sector comprises:

electromagnetically actuating the at least one sector when rotating at least one of the polishing pad and the substrate.

17. A method for polishing a substrate, the method comprising:

disposing a polishing pad on a platen;

supplying slurry onto the polishing pad;

holding the substrate against the polishing pad by a polishing head;

actuating a plurality of pressure sectors on the polishing head to telescopically move to apply localized pressures on the substrate against the polishing pad, wherein actuating the pressure sectors is performed such that an elastic element connecting one of the pressure sectors and the polishing head is shortened when said one of the pressure sectors moves close to the polishing head; and rotating at least one of the platen and the polishing head.

18. The method of claim 17, wherein at least one of the pressure sectors is electromagnetism actuated.

19. The method of claim 17, further comprising:

sensing displacements of the pressure sectors; and calibrating the polishing head according to the sensed displacements of the pressure sectors.

20. The method of claim 17, wherein actuating the pressure sectors is performed such that the elastic element is elongated when said one of the pressure sectors moves away from the polishing head.

* * * * *